US010498077B2

(12) United States Patent
Ohsako

(10) Patent No.: US 10,498,077 B2
(45) Date of Patent: Dec. 3, 2019

(54) POWER CONNECTOR AND POWER CONNECTOR DEVICE

(71) Applicant: HIROSE ELECTRIC CO., LTD., Tokyo (JP)

(72) Inventor: Tetsutaro Ohsako, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/220,837

(22) Filed: Dec. 14, 2018

(65) Prior Publication Data

US 2019/0190197 A1 Jun. 20, 2019

(30) Foreign Application Priority Data

Dec. 20, 2017 (JP) ..... 2017-243751

(51) Int. Cl.

| | |
|---|---|
| ***H01R 13/627*** | (2006.01) |
| ***H01R 13/629*** | (2006.01) |
| ***H01R 12/70*** | (2011.01) |
| ***H01R 12/71*** | (2011.01) |
| ***H01R 13/502*** | (2006.01) |
| ***H01R 13/436*** | (2006.01) |
| ***H01R 13/422*** | (2006.01) |

(52) U.S. Cl.

CPC ..... *H01R 13/629* (2013.01); *H01R 12/7011* (2013.01); *H01R 12/7088* (2013.01); *H01R 12/716* (2013.01); *H01R 13/4223* (2013.01); *H01R 13/436* (2013.01); *H01R 13/502* (2013.01)

(58) Field of Classification Search

CPC ..... H01R 13/6275; H01R 13/6272; H01R 13/6273; H01R 13/6335; H01R 13/64

USPC ..... 439/358, 357, 353, 680, 488, 483

See application file for complete search history.

(56) References Cited

U.S. PATENT DOCUMENTS 8,052,458 B2 * 11/2011 Rossman ..... H01R 13/6456 439/358

8,998,651 B2 * 4/2015 Chen ..... H01R 13/64 439/677

FOREIGN PATENT DOCUMENTS

JP 2002056919 A 2/2002

* cited by examiner

*Primary Examiner* — Phuong Chi Thi Nguyen

(74) *Attorney, Agent, or Firm* — Rankin, Hill & Clark LLP

(57) ABSTRACT

Provided is a power connector comprising: a housing; a power supply terminal; a regulatory protruding portion; and a locking portion, wherein the housing includes, therein, an insertion space configured in such a manner that at least part of a counterpart housing of a counterpart connector is inserted thereinto, the insertion space communicates with an insertion port, the power supply terminal includes an exposed portion provided in a state of being exposed from the housing toward the insertion space, and a contact portion being at least part of the power supply terminal, the contact portion being configured to come into contact with a counterpart-side power supply terminal provided to the counterpart housing upon at least part of the counterpart housing being inserted through the insertion port, the regulatory protruding portion is placed on a side closer to the insertion port than to the exposed portion in a direction of the insertion of at least part of the counterpart housing, in the insertion space, the regulatory protruding portion protruding from the housing toward the insertion space, and the locking portion is provided in the insertion space, and is configured to lock a locking portion provided to the counterpart housing upon at least part of the counterpart housing being inserted. The contact portion may have a flat plate shape.

12 Claims, 5 Drawing Sheets

POWER CONNECTOR AND POWER CONNECTOR DEVICE

CROSS-REFERENCE TO RELATED APPLICATION

This application claims priority from Japanese Patent Application 2017-243751 filed with the Japan Patent Office on Dec. 20, 2017, the entire content of which is hereby incorporated by reference.

BACKGROUND

1. Technical Field

The present disclosure relates to a power connector and a power connector device, and particularly relates to a power connector and a power connector device, which have a finger protection function for avoiding erroneous contact of a component with a power supply terminal, across which a voltage is being applied, of the power connector, or electrical shock to an operator.

2. Related Art

JP-A-2002-56919 discloses a power connector device having what is called a finger protection function. The power connector device includes a pair of a male connector and a female connector that can be mated to the male connector.

The male connector incudes a male connector housing having an inner housing and an outer housing, and a male terminal fitting provided to the inner housing. On the other hand, the female connector incudes a female connector housing and a female terminal fitting provided to the female connector housing.

A housing space where a terminal housing tube portion of the female connector housing is housed is provided inside the outer housing of the male connector. In the housing space, a regulatory protruding portion protrudes toward the inside of the housing space to prevent a test finger prescribed by a standard from excessively entering the housing space. Moreover, a lock protruding portion where a lock arm of the female connector is locked is provided on an upper surface of the outside of the outer housing of the male connector. The lock arm of the female connector is provided outside the terminal housing tube portion of the female connector housing housed in the housing space.

When the male and female connectors are mated, the terminal housing tube portion of the female connector housing is housed in the housing space of the outer housing of the male connector. Moreover, it is configured in such a manner that the lock arm provided outside the terminal housing tube portion of the female connector is locked to the lock protruding portion provided on the outside of the outer housing of the male connector.

Such a typical power connector device as disclosed in JP-A-2002-56919 is configured to provide the lock protruding portion on the outside of the outer housing of the male connector to have the function of locking the lock arm. Hence, the size of the male connector tends to increase; therefore, the size of the female connector also tends to increase.

A reduction in the size of a connector device has been recently increasingly requested. An improvement in the connector structure is required for this request. An embodiment of the present disclosure has been made to solve such a problem. An object thereof is to add a locking function to a power connector having a finger protection function without increasing the sizes of the connector and a connector device.

SUMMARY

In order to solve the above problem, provided is a power connector comprising: a housing; a power supply terminal; a regulatory protruding portion; and a locking portion, wherein the housing includes, therein, an insertion space configured in such a manner that at least part of a counterpart housing of a counterpart connector is inserted thereinto, the insertion space communicates with an insertion port, the power supply terminal includes an exposed portion provided in a state of being exposed from the housing toward the insertion space, and a contact portion being at least part of the power supply terminal, the contact portion being configured to come into contact with a counterpart-side power supply terminal provided to the counterpart housing upon at least part of the counterpart housing being inserted through the insertion port, the regulatory protruding portion is placed on a side closer to the insertion port than to the exposed portion in a direction of the insertion of at least part of the counterpart housing, in the insertion space, the regulatory protruding portion protruding from the housing toward the insertion space, and the locking portion is provided in the insertion space, and is configured to lock a locking portion provided to the counterpart housing upon at least part of the counterpart housing being inserted.

DETAILED DESCRIPTION

Figure 1:
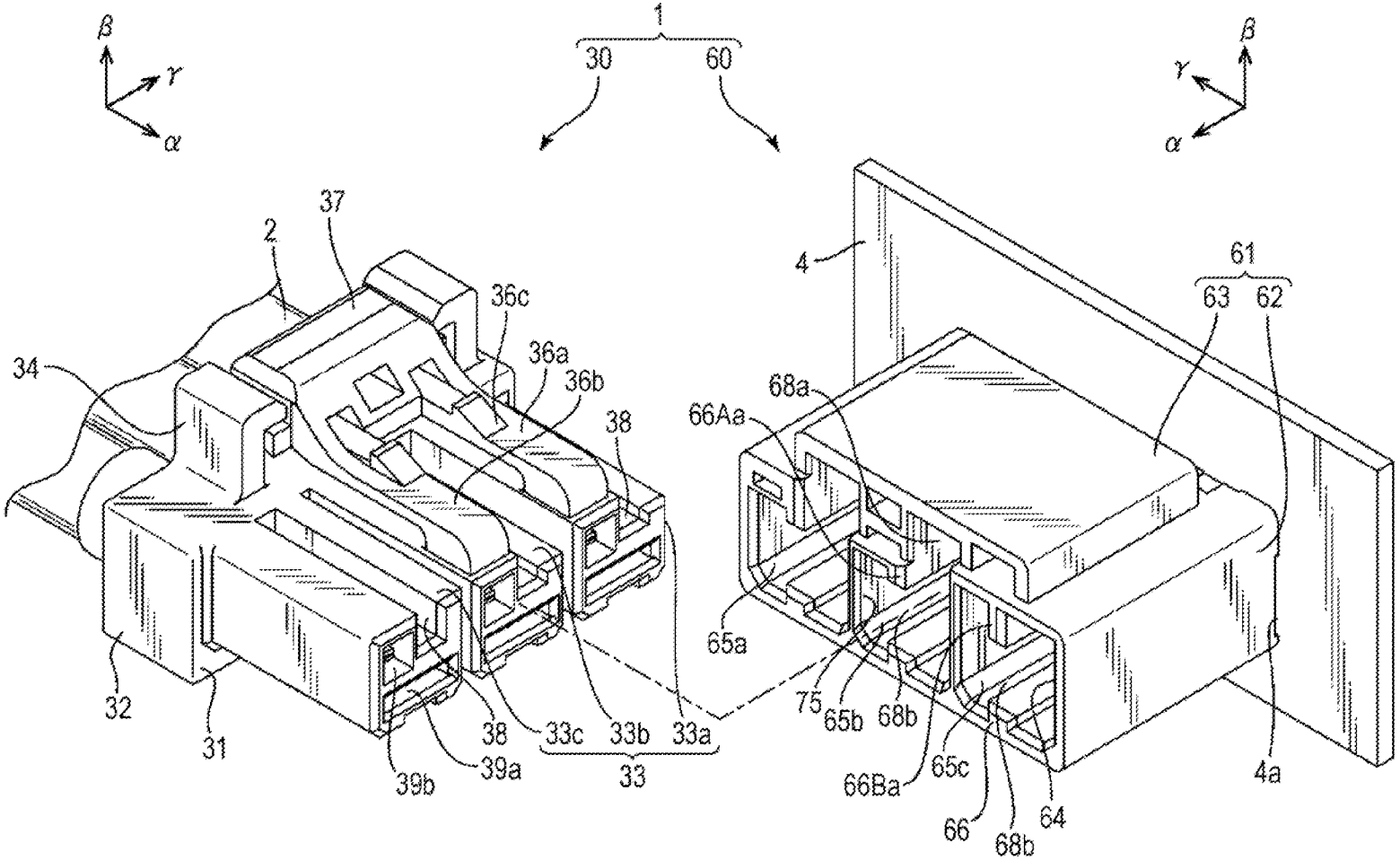
FIG. 1 is a perspective view of a power connector device according to one embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

One preferred embodiment of the present disclosure is described hereinafter with reference to the accompanying drawings. For the convenience of description, only the preferred embodiment is illustrated; however, naturally, this is not intended to limit the present disclosure. According to a power connector according to the embodiment of the present disclosure, a corresponding locking portion is provided in an insertion space provided inside a housing. Therefore, at least part of a counterpart housing inserted in the insertion space is locked not outside but inside the housing. Therefore, a locking function can be added to a power connector having a finger protection function without increasing the sizes of the connector and a connector device.

In the power connector of the above aspect, the power supply terminal includes a plurality of power supply terminals in such a manner as to be adjacent to each other. It is preferable that a partition divide the insertion space where the power supply terminals are placed.

According to the power connector of the aspect, such a partition can separate the power supply terminals through which a large current may pass. Therefore, a creepage distance between these terminals can be increased.

Moreover, in the power connector of the above aspect, it is preferable that the regulatory protruding portion have a pair of projections placed in such a manner as to face each other in a cross section perpendicular to the insertion direction.

According to the power connector of the aspect, the pair of regulatory protruding portions is placed in such a manner as to face each other in the cross section. Therefore, the possibility for a test finger to collide with the regulatory protruding portions increases, and the finger protection function can be improved.

Furthermore, in the power connector of the above aspect, it is preferable that the insertion space include a first compartment portion into which the locking portion of at least part of the counterpart housing is inserted upon at least part being inserted, and a second compartment portion into which a part other than the locking portion is inserted upon at least part of the counterpart housing being inserted.

Moreover, in the power connector of the above aspect, it is preferable that the plane include a first direction and a second direction perpendicular to the first direction in the plane perpendicular to the insertion direction, and the pair of regulatory protruding portions each protrude toward an inside of the insertion space along the first direction in such a manner as to be close to each other, and include an overlap in the second direction.

According to the power connector of the aspect, the overlap is provided to the pair of regulatory protruding portions placed in such a manner as to face each other; accordingly, it is possible to effectively prevent the insertion of, for example, the test finger and further improve the finger protection function.

Furthermore, in the power connector of the above aspect, it is preferable that the power supply terminal extend in the second direction, and includes a part overlapping with at least one of the pair of regulatory protruding portions in the second direction.

According to the power connector of the aspect, the overlapping part is provided between the pair of regulatory protruding portions and the power supply terminal. Accordingly, the finger protection function can be further improved.

Furthermore, in the power connector of the above aspect, it is preferable that the first and second compartment portions be placed in such a manner as to be adjacent to each other along the first direction, and include a part overlapping in the second direction.

Moreover, in the power connector of the above aspect, it is preferable that the first compartment portion be smaller in at least the second direction than the second compartment portion.

Figure 2:
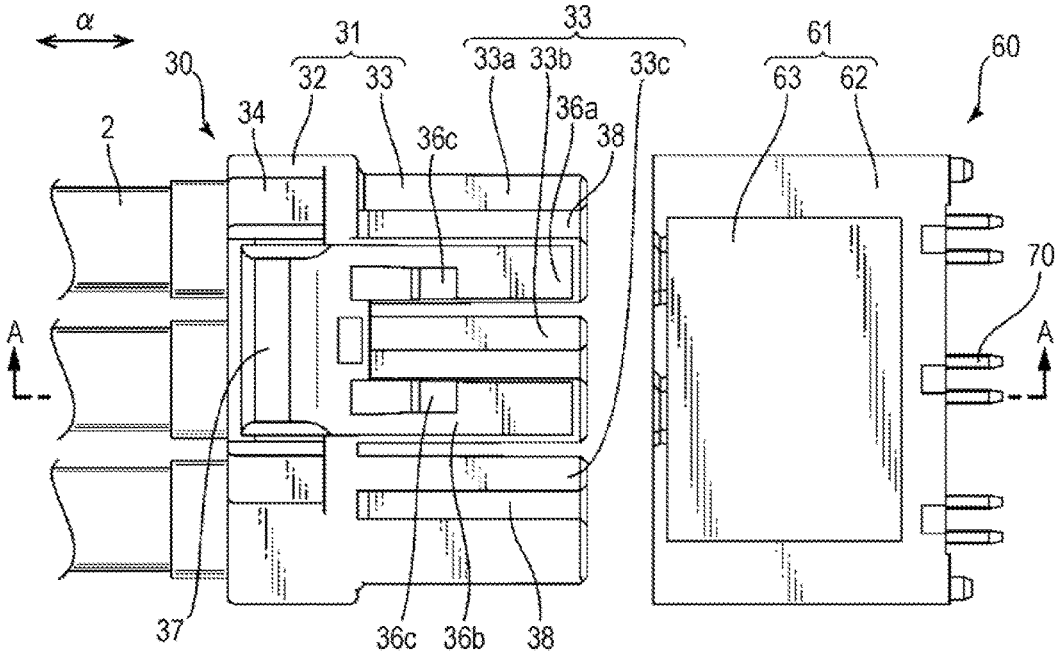
FIG. 2 is a plan view of the power connector device according to the embodiment of the present disclosure.

FIG. 1 illustrates a perspective view of a power connector device 1 according to one embodiment of the present disclosure. Moreover, FIG. 2 illustrates a plan view thereof. Moreover, FIG. 3 is a cross-sectional view taken along line A-A in FIG. 2.

The power connector device 1 may include, for example, a pair of a cable connector 30 to which a cable 2 is fixed, and a board connector 60 that is fixed to a board 4. These cable connector 30 and board connector 60 can be mated by butting each other in an illustrated arrow "α" direction. FIGS. 1 to 3 illustrate a state before the cable connector 30 and the board connector 60 are mated.

Figure 3:
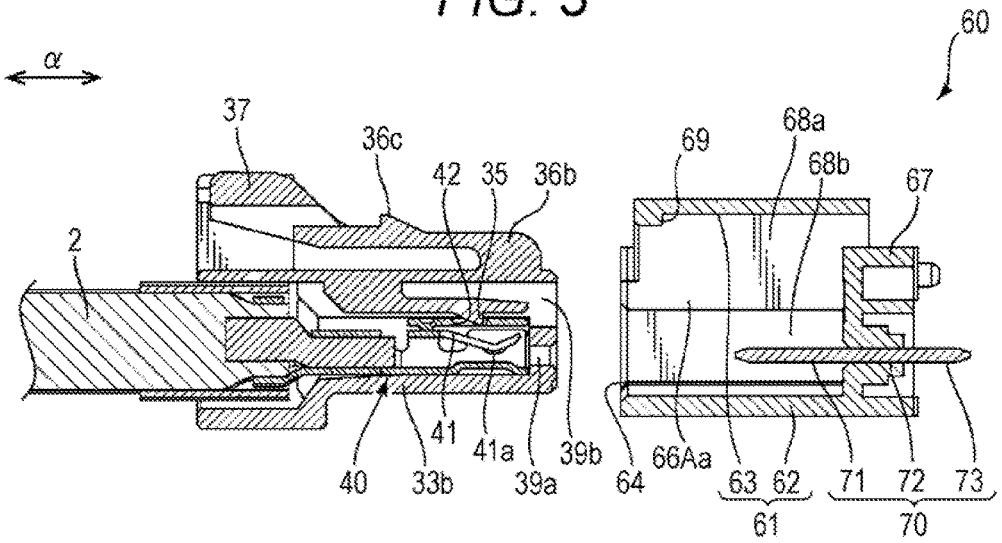
FIG. 3 is a cross-sectional view of the power connector device illustrated in FIG. 2, taken along line A-A.

The cable connector 30 includes a housing 31 fixed to an end of the cable 2, and power supply terminals 40 fixed in the housing 31 as illustrated in FIG. 3. The power supply terminal 40 is electrically connected to a predetermined part of the cable 2.

The housing 31 includes a substantially cuboid main body 32 that has a length in a width direction (an illustrated arrow "γ"). The cable 2 is fixed on one side surface of the main body 32. A plurality of inserted portions 33 extends along the insertion (that is, mating with the board connector 60) direction "α" from a side surface in the α direction in the drawings (that is, the longitudinal direction of the main body 32 perpendicular to the γ direction) opposite the side where the cable 2 is fixed. Each of the inserted portions 33 of the housing 31 has a substantially rectangular tubular shape. Provided here are three inserted portions 33*a* to 33*c* in total that are spaced apart from each other in the width direction "γ". At least part of these inserted portions 33*a* to 33*c* is inserted into the board connector 60 when the cable connector 30 and the board connector 60 are mated.

A guide groove 38 is provided to one side surface of each of the inserted portions 33*a* to 33*c* along the α direction. When the cable connector 30 and the board connector 60 are mated, the guide grooves 38 are engaged with corresponding parts of the board connector 60; accordingly, the mating parts of the cable connector 30 and the board connector 60 can be easily aligned.

A predetermined side surface(s) of at least one of the inserted portions 33*a* to 33*c*, two inserted portions 33*a* and 33*b* here, are provided with locking parts 36*a* and 36*b* as part of the inserted portions 33*a* and 33*b*. These locking parts 36*a* and 36*b* are formed in cantilever fashion along the insertion direction "α" from the side that is mated to the board connector 60 (that is, the right side in FIG. 1) toward the opposite side (the left side in FIG. 1). These locking parts 36*a* and 36*b* are always biased with elastic force in a direction away from a main body of the inserted portion in a height direction "β" in FIG. 1 perpendicular to both the insertion direction "α" and the width direction "γ" of the housing 31.

An outer surface of each of the locking parts 36*a* and 36*b*, for example, a top surface in the β direction in FIG. 1 at a middle position on the rear side in the insertion direction "α", is provided with a locking claw (locking portion) 36*c* as illustrated in FIG. 1. The locking claw 36*c* is configured in such a manner that part of an inside of the board connector 60 is locked thereto when the cable connector 30 and the board connector 60 are mated. In other words, when the cable connector 30 and the board connector 60 are mated, the locking parts 36*a* and 36*b* are inserted into the board connector 60 up to at least the positions of the locking claws 36*c*. At the time of mating, the elasticity of the locking parts 36*a* and 36*b* in the height direction "β" is used to enable the locking claws 36*c* to be locked to corresponding parts (recesses 69 in FIG. 3) of the board connector 60. An operation portion 37 provided on a free end side of the locking parts 36*a* and 36*b*, that is, a side that is biased in the β direction with elastic force presses the locking claws 36*c* down toward the main body 32 of the housing 31. In other words, the operation portion 37 allows the locked state of the locking claws 36*c* and the corresponding parts, that is, the recesses 69, of the board connector 60 to be easily released. In order to further facilitate the operation for release, it is preferable that the operation portion 37 be formed as a common operation portion in such a manner as to work on the locking claws 36*c* of both the inserted portions 33*a* and 33*b*. As an example, the operation portion 37 may be configured to cover the inserted portions along their total length in the width direction, that is, the γ direction as illustrated in FIG. 1. The operation portion 37 is easily broken and accordingly may still be protected in such a manner as to sandwich left and right side surfaces thereof with protective walls 34 arranged vertically upward of the main body 32 as illustrated in FIG. 1.

A front end surface of each of the inserted portions 33*a* to 33*c* is provided with a terminal insertion port 39*a* into which a power supply terminal (70 in FIG. 3) provided to the board connector 60 is inserted. When the cable connector 30 and the board connector 60 are mated, the power supply terminal 70 is inserted into the terminal insertion port 39*a*. Furthermore, a lance hole 39*b* for fixing the power supply terminal 40 illustrated in FIG. 3 to each of the inserted portions 33*a* to 33*c* is provided above the terminal insertion port 39*a* in such a manner as to be adjacent to the guide groove 38 in the width direction "γ".

The power supply terminal 40 is formed in a substantially rectangular tubular shape by blanking one metal sheet, followed by bending. As illustrated in FIG. 3, part of an upper plate of the power supply terminal 40 is bent in the β direction, that is, a plate-thickness direction to form a contact piece 41 in cantilever fashion. A contact 41*a* with the power supply terminal is provided on a distal end side of the contact piece 41 by bending the contact piece 41 in U-shape in the plate-thickness direction. Moreover, part of the upper plate is provided with a hole 42 and accordingly is formed in such a manner as to catch part of a lance 35 of the housing 31 in the hole 42.

The board connector 60 includes a housing 61 and the terminals 70 fixed to the housing 61. The housing 61 is mounted on one surface 4*a* of the board 4. Moreover, the housing 61 is positioned at a predetermined position of the board 4 by inserting a projection (not illustrated) provided to the housing 61 into a hole (not illustrated) provided to the board 4.

The housing 61 includes a substantially cuboid main body 62 and a step portion 63 provided on one side surface of the main body 62. Insertion spaces 65*a* to 65*c* into which at least parts of the inserted portions 33*a* to 33*c* of the cable connector 30 are inserted respectively are provided inside the housing 61. The insertion spaces 65*a* to 65*c* are provided in a state of communicating with their respective insertion ports 64. The insertion spaces 65*a* to 65*c* are arranged in a line along the width direction "γ" of the housing 61. Each of the insertion spaces 65*a* to 65*c* that are adjacent to each other is separated by a partition 73. Such a configuration allows the inserted portions 33*a* to 33*c* of the cable connector 30 to be inserted into and removed from the insertion spaces 65*a* to 65*c* through the insertion ports 64 along the insertion direction "α".

The recess 69 (refer to FIG. 3) being a corresponding locking portion is provided inside the insertion port 64, corresponding to the locking claw 36*c* provided to each of the locking parts 36*a* and 36*b* of the inserted portions 33*a* and 33*b*. When the inserted portions 33*a* and 33*b* of the cable connector 30 are inserted into the insertion spaces 65*a* and 65*b* through the insertion ports 64, the locking claws 36*c* provided to the inserted portions 33*a* and 33*b* can be elastically locked to the recesses 69, respectively. The corresponding locking portion 69 is not necessarily required to be provided to the insertion port 64 but is simply required to be provided in the insertion space 65. Furthermore, the corresponding locking portion 69 is simply required to be provided to not the outside but the inside of the housing 61. In this manner, the corresponding locking portion is provided in the insertion space provided inside the housing to enable locking to at least part of a counterpart housing inserted in the insertion space, the housing of the cable connector 30 in this case, not outside but inside the housing. Therefore, the locking function can be added to the power connector without increasing the sizes of the connector and the connector device.

In order to receive the locking parts 36*a* and 36*b* of the cable connector 30, the insertion spaces 65*a* and 65*b* include a first compartment portion 68*a* into which mainly the locking parts 36*a* and 36*b* of the inserted portions 33*a* and 33*b* are inserted, and a second compartment portion 68*b* into which mainly a part other than the locking parts 36 is inserted. The first compartment portion 68*a* is formed mainly by the step portion 63. On the other hand, the second compartment portion 68*b* is formed mainly by the main body 62. The inserted portion 33*c* is not provided with a locking part. Therefore, the insertion space 65*c* into which the inserted portion 33*c* is inserted includes only the second compartment portion 68*b*.

Each of the first compartment portion 68*a* and the second compartment portion 68*b* has a substantially rectangular shape in a cross section "β-γ" perpendicular to the insertion direction "α". In the cross section, there are the height direction "β" and the width direction "γ". The first compartment portion 68*a* and the second compartment portion 68*b* are placed in such a manner as to be adjacent to each other along the height direction "β". In addition, the first compartment portion 68*a* and the second compartment portion 68*b* have an overlap in the width direction "γ".

The power supply terminal 70 is provided in each of the insertion spaces 65*a* to 65*c* of the housing 61 of the board connector 60. The power supply terminal 70 includes a flat plate-shaped support portion 72 supported by protruding walls 67 of the housing 31, an exposed portion 71 located to a front side of the protruding wall 67, that is, to the cable connector 30 side after mating, and a mounting portion 73 located to a rear side of the protruding wall 67. The exposed portion 71 is placed in a state of protruding toward the insertion port 64, and is provided in a state of being exposed to the mated cable connector 30 in each of the insertion spaces 65*a* to 65*c*. In other words, at least part of the exposed portion 71 functions as a contact portion that comes into contact with the power supply terminal 40 of the cable connector 30 when the cable connector 30 and the board connector 60 are mated. The mounting portion 73 is a part that is mounted on the board 4 (refer to FIG. 1), and is fixed to the board 4 in a predetermined method, for example, by soldering.

The power supply terminal 70 may be, for example, a terminal that, as a whole, has a flat plate shape, in other words, expands in the insertion direction "α" and the width direction "γ". Moreover, the power supply terminal 70 may have a flat plate shape only at a contact part of the exposed portion 71, which comes into contact with the power supply terminal 40 of the cable connector 30. A plurality of the power supply terminals 70 is placed in such a manner as to be adjacent to each other along the width direction "γ" in a state of being separated from each other by the partitions 73. In this manner, the power supply terminals through which a large current may pass are separated by the partitions 73; accordingly, the creepage distance can be increased.

When the inserted portions 33 are inserted into the insertion spaces 65 through the insertion ports 64, the guide grooves 38 of the inserted portions 33*a* to 33*c* are engaged with upper protruding portions 66Aa and 66Ba provided in the insertion spaces 65; accordingly, the mating parts of the cable connector 30 and the board connector 60 can be easily aligned. When the inserted portions 33 are inserted into the insertion spaces 65, each power supply terminal 70 can come into contact with the contact 41*a* of the power supply terminal 40 provided in the inserted portion 33 by using the elastic action of the contact piece 41. As a result, the power supply terminal 40 of the cable connector 30 and the power supply terminal 70 of the board connector 60 can be electrically connected.

Figure 4:
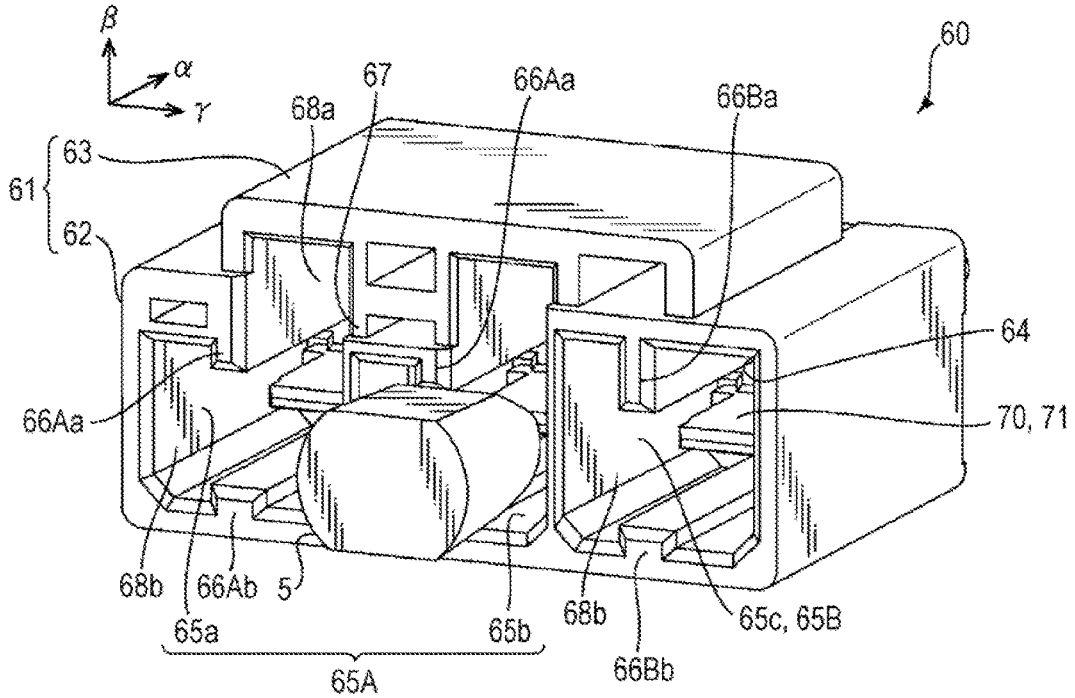
FIG. 4 is a perspective view of a connector according to the present disclosure.
Figure 5:
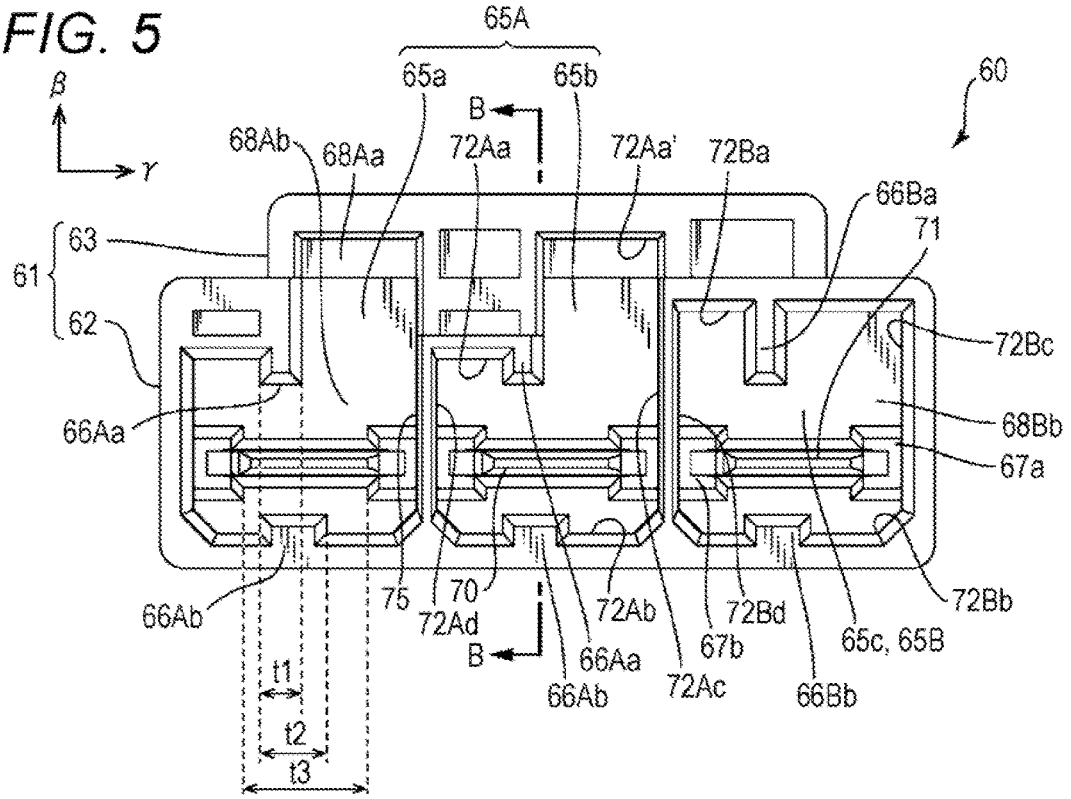
FIG. 5 is a front view of a board connector illustrated in FIG. 4.
Figure 6A:
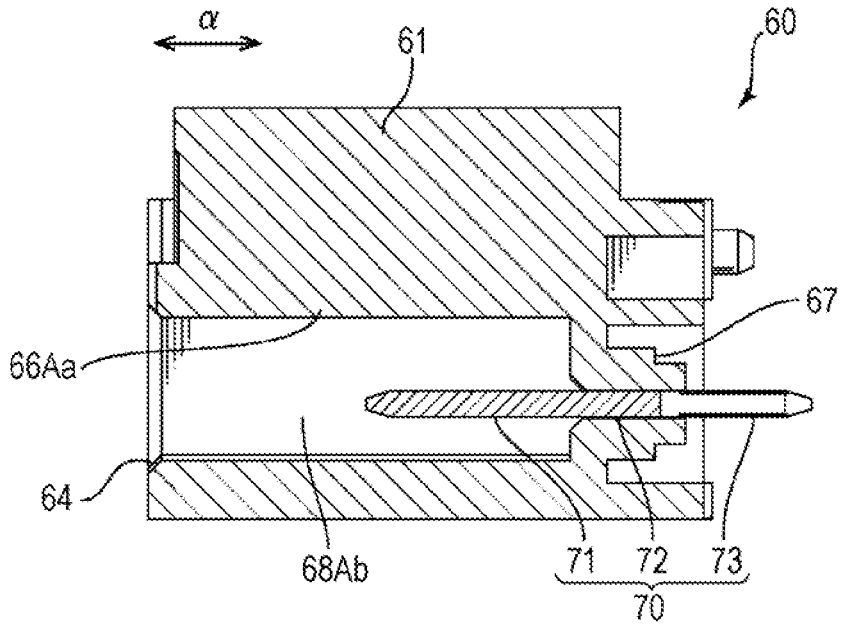
FIGS. 6A and 6B are cross-sectional views of the connector illustrated in FIG. 5, taken along line B-B.
Figure 6B:
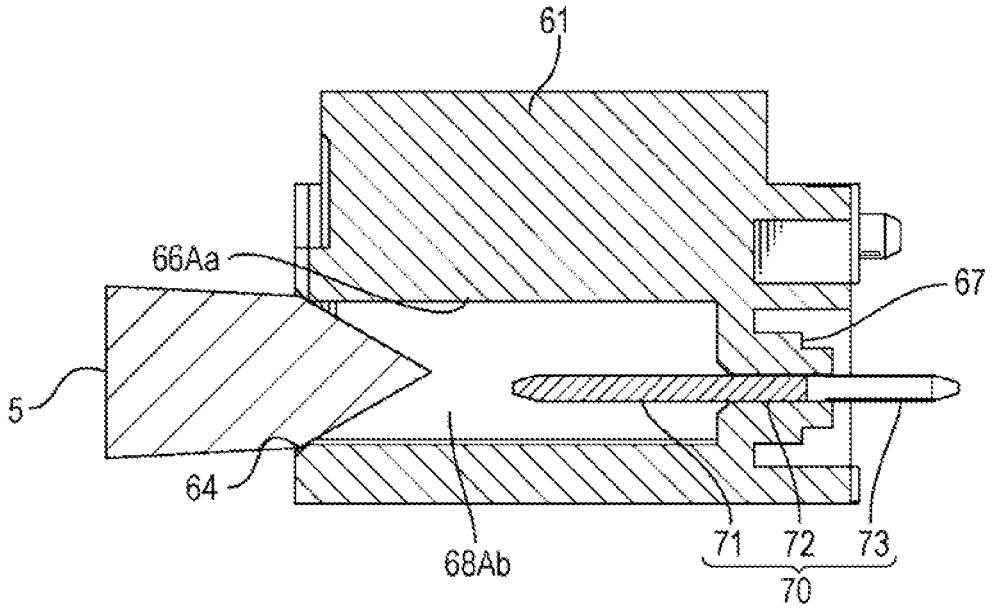

The finger protection function is described with reference also to FIGS. 4 to 6. FIG. 4 is a perspective view of the board connector 60. FIG. 5 is a front view thereof. FIGS. 6A and 6B are cross-sectional views taken along line B-B in FIG. 5.

The finger protection function is evaluated with a standardized test finger. As the standard, there are, for example, UL and TUV. FIG. 4 illustrates the board connector 60 and also illustrates an example of a test form. The illustrated example illustrates a test method for the insertion space 65*b*. The insertion spaces 65*a* and 65*c* are also tested in a similar method. The test evaluates whether or not a test finger 5 likened to a finger comes into electrical contact with the exposed portion 71 of the power supply terminal 70 provided inside the insertion space 65 when an attempt is made to insert the test finger 5 into the insertion space 65 with a predetermined force as illustrated in FIG. 6B. If there is no contact, the function is evaluated as satisfactory. If there is contact, it is evaluated as unsatisfactory.

In order to add the finger protection function, the second compartment portions 68*b* of the insertion spaces 65 are provided with a plurality of regulatory protruding portions 66 (66Aa, 66Ab, 66Ba, and 66Bb). Each of these regulatory protruding portions 66 protrudes as a projection toward the inside of the insertion space 65 along the β direction. Moreover, each of these regulatory protruding portions 66 is placed at some position on a side closer to the insertion port 64 than to the exposed portion 71 of the power supply terminal 70 in the insertion direction "α" of the inserted portion 33 into the insertion space 65. In the embodiment, the regulatory protruding portion is provided to the insertion port 64 but is not necessarily required to be provided to the insertion port 64. As long as it is possible to satisfactorily exert the finger protection function, it is simply required to provide the regulatory protruding portion at some position in the insertion space 65 other than the insertion port 64. Moreover, in the embodiment, the second compartment portion 68*b* having a larger cross section than the first compartment portion 68*a* is provided with the regulatory protruding portions 66. However, it is not necessarily required to provide the regulatory protruding portions to the second compartment portion 68*b*. As long as it is possible to satisfactorily exert the finger protection function, the regulatory protruding portions may be provided to the first compartment portion 68*a*. Furthermore, the regulatory protruding portions may be provided to both the first compartment portion 68*a* and the second compartment portion 68*b*. Furthermore, as long as a similar finger protection function works, a member other than the regulatory protruding portion, for example, a rod-like member protruding toward the insertion port 64 may be provided along the insertion direction "α" may be provided.

The regulatory protruding portion 66 and the insertion space 65 are described in more detail with reference to FIGS. 5 and FIGS. 6A and 6B. As is clear from the above description, there are two types of the insertion spaces 65. In other words, there are a type 65A including both the first compartment portion 68*a* and the second compartment portion 68*b* to receive the locking part 36 provided to the cable connector 30 as in the insertion spaces 65*a* and 65*b*, and a type 65B not including the first compartment portion 68*a* but including only the second compartment portion 68*b* to not receive the locking part 36 as in the insertion space 65*c*. They are distinguished below as appropriate, assigning the letter A to reference numerals of members related to the former type, and the letter B to reference numerals of members related to the latter type.

The regulatory protruding portions in the insertion spaces 65A and 65B (65*a*, 65*b*, and 65*c*) are pairs of the regulatory protruding portions 66Aa and 66Ab and a pair of the regulatory protruding portions 66Ba and 66Bb, each pair being placed in such a manner as to face each other in a plane of the cross-section "β-γ" perpendicular to the insertion direction "α". The paired regulatory protruding portions are provided in such a manner as to be close to each other. The regulatory protruding portion 66Aa protrudes downward in FIG. 5 in the height direction "β" from not an upper inner wall 72Aa' at a high part forming the first compartment portion 68Aa but an upper inner wall 72Aa at a low part forming the second compartment portion 68Ab toward the inside of the insertion space 65A. Moreover, the regulatory protruding portion 66Ba protrudes downward in FIG. 5 in the height direction "β" from an upper inner wall 72Ba forming the second compartment portion 68Bb toward the inside of the insertion space 65B. On the other hand, the regulatory protruding portions 66Ab and 66Bb protrude upward in FIG. 5 in the height direction "β" from bottom-side inner walls 72Ab and 72Bb forming the second compartment portions 68Ab and 68Bb toward the insides of the insertion spaces 65A and 65B, respectively. In this manner, the paired regulatory protruding portions are placed in such a manner as to face each other in the plane of the cross-section "β-γ"; accordingly, it is easy for the test finger 5 to collide with these regulatory protruding portions 66Aa and 66Ab. Therefore, the finger protection function can be improved.

It is preferable that the paired regulatory protruding portions each have an overlap in the width direction "γ", that is, a part placed at the same position in the "γ" direction. In the embodiment, each of the pair of the regulatory protruding portions 66Aa and 66Ab and the other pair of the regulatory protruding portions 66Ba and 66Bb has an overlap in the width direction "γ". Such an overlap is provided to effectively prevent the insertion of a test finger and the like. Therefore, the finger protection function can be further improved.

Moreover, if the plurality of the power supply terminals 70 extends in the width direction "γ" as in the embodiment, it is preferable that the power supply terminal 70 have an overlap with one of the pair of the regulatory protruding portions in the width direction "γ". In the embodiment, the power supply terminal 70 has, for example, an overlapping part "t1" with the regulatory protruding portion 66Aa in the width direction "γ". Moreover, the power supply terminal 70 has an overlapping part "t2" with the regulatory protruding portion 66Ab. Such overlapping parts are provided to enable a further improvement in the finger protection function. Moreover, it is preferable to set the first compartment portion 68*a* to be smaller in the width direction "γ" than the second compartment portion 68*b* to further improve the finger protection function. As illustrated in FIG. 5, the power supply terminal 70 can be supported by a pair of protruding walls 67*a* and 67*b* extending from a pair of right and left inner walls 72Ac and 72Ad, or another pair of right and left inner walls 72Bc and 72Bd, which forms the insertion space 65. The pair of protruding walls 67*a* and 67*b* extends in a direction crossing the regulatory protruding portion 66 and therefore functions not only to support the power supply terminal 70 but also to increase the strength of the insertion space 65.

Figure 7:
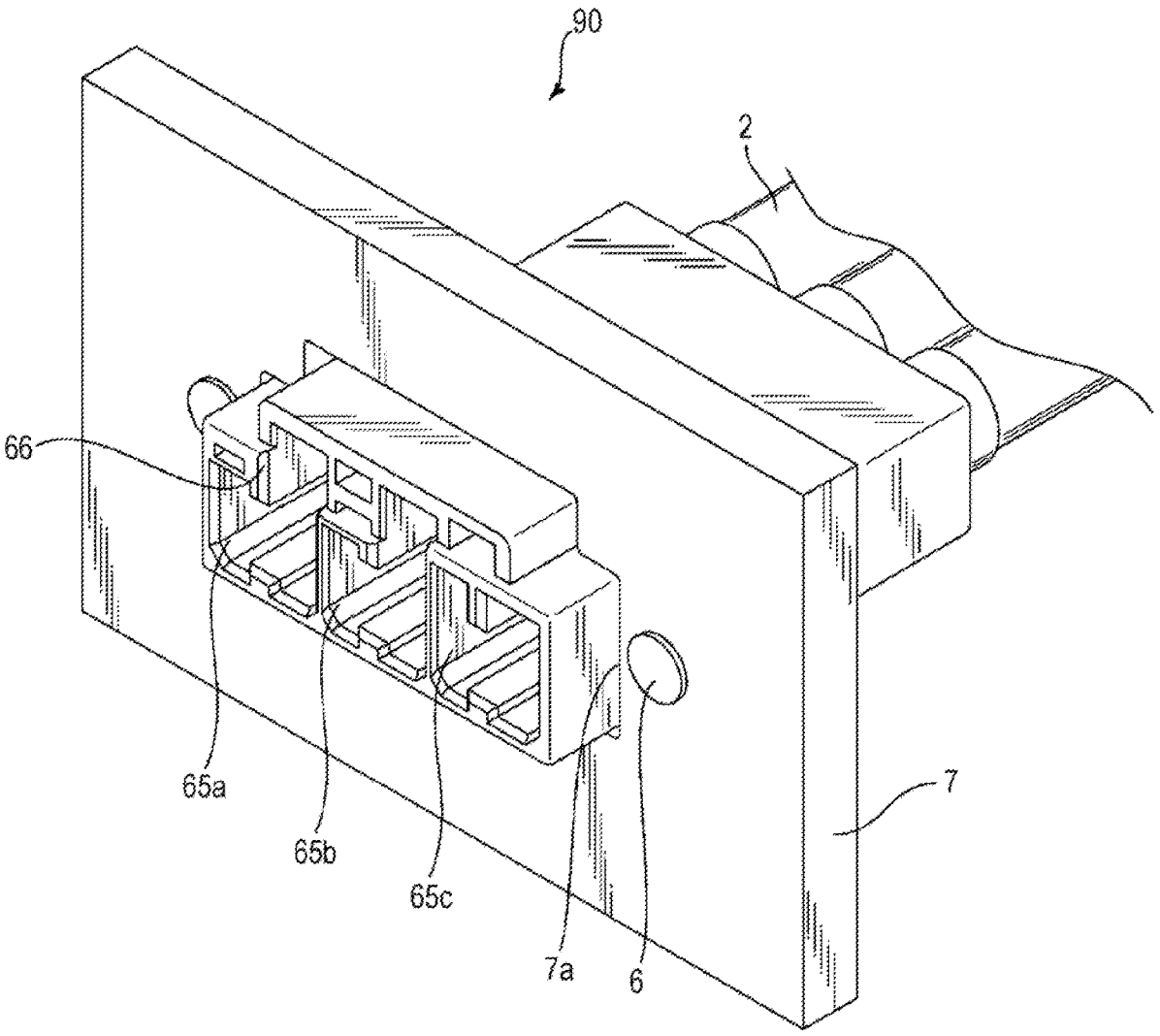
FIG. 7 is a perspective view illustrating a modification of the connector according to the present disclosure.

FIG. 7 illustrates a modification. The embodiment illustrated in, for example, FIG. 1 illustrates a combination of the cable connector 30 connected to the cable 2, and a board connector 60 fixed to a board. Naturally, the use mode is not limited to this. As illustrated in FIG. 7, for example, the cable connector 90 may be fixed to a panel 7. The panel 7 is provided with a hole 7*a* through which part of a distal end of the cable connector 90 penetrates. A screw hole 6 that allows a screw for further fixing the panel 7 to a casing or the like to penetrate is provided on each of the left and right sides of the hole 7*a*.

The above description relates to the preferred embodiment, and should be understood to be simply representatives of an article and a method for manufacturing the same. It is possible to recognize that different modifications and corrections of the embodiment are clearly evident to those skilled in the art in light of the above-mentioned instruction. Therefore, illustrative embodiments and alternative embodiments can be carried out without departing from the spirit of the article and method described in the accompanying claims.

The power connector and the power connector device according to the present disclosure may be the following first to tenth power connectors and power connector device.

The first power connector includes: a housing having, therein, an insertion space into which at least part of a counterpart housing of a counterpart connector is inserted; a power supply terminal having a contact portion being at least part of an exposed portion provided in a state of being exposed in the insertion space, the contact portion being capable of coming into contact with a counterpart power supply terminal provided to the counterpart housing upon at least part of the counterpart housing being inserted into the insertion space through an insertion port communicating with the insertion space; a regulatory protruding portion placed at some position on a side closer to the insertion port than to the exposed portion of the power supply terminal in a direction of the insertion of at least part of the counterpart housing into the insertion space, the regulatory protruding portion protruding in such a manner that at least a standardized test finger does not touch the exposed portion of the power supply terminal upon an attempt being made to insert the test finger into the insertion space through the insertion port; and a corresponding locking portion provided in the insertion space, the corresponding locking portion being capable of locking a locking portion provided to the counterpart housing upon at least part of the counterpart housing being inserted into the insertion space through the insertion port.

The second power connector is the first power connector wherein the power supply terminal includes a plurality of power supply terminals in such a manner as to be adjacent to each other, and a partition divides the insertion space where the power supply terminals are placed.

The third power connector is the first or second power connector wherein the regulatory protruding portion includes a pair of regulatory protruding portions placed in such a manner as to face each other in a cross section perpendicular to the insertion direction.

The fourth power connector is the third power connector wherein the insertion space has a first compartment portion in the insertion space, into which mainly a locking part provided with the locking portion of at least part of the counterpart housing is inserted upon at least part being inserted into the insertion space through the insertion port, and a second compartment portion in the insertion space, into which mainly a part other than the locking part of at least part of the counterpart housing is inserted upon at least part being inserted into the insertion space through the insertion port.

The fifth power connector is the fourth power connector wherein in the cross section perpendicular to the insertion direction, the cross section has a first direction and a second direction perpendicular to the first direction, and the pair of regulatory protruding portions each protrudes toward the inside of the insertion space along at least the first direction in such a manner as to be close to each other, and the pair of regulatory protruding portions has an overlap in the second direction.

The sixth power connector is the fifth power connector wherein the power supply terminal extends substantially in the second direction, and has an overlap with at least one of the pair of regulatory protruding portions in the second direction.

The seventh power connector is any of the fourth to sixth power connectors wherein the first and second compartment portions are placed in such a manner as to be adjacent to each other along the first direction, and have an overlap in the second direction.

The eighth power connector is the seventh power connector wherein the first compartment portion is set to be smaller in at least the second direction than the second compartment portion.

The ninth power connector is any of the first to seventh power connectors wherein the contact portion has a flat plate shape.

The tenth power connector device is a power connector device including any of the first to ninth power connectors and the counterpart connector.

The foregoing detailed description has been presented for the purpose of illustration and description. Many modifications and variations are possible in light of the above teaching. It is not intended to be exhaust or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A power connector comprising:

a housing;

a power supply terminal;

a regulatory protruding portion; and a locking portion, wherein the housing includes, therein, an insertion space configured in such a manner that at least part of a counterpart housing of a counterpart connector is inserted thereinto, the insertion space communicates with an insertion port and comprises an upper inner wall and a bottom-side inner wall opposite to the upper inner wall in a first direction perpendicular to a direction of the insertion of at least part of the counterpart housing in the insertion space, the power supply terminal includes an exposed portion provided in a state of being exposed from the housing toward the insertion space, and a contact portion being at least part of the power supply terminal, the contact portion being configured to come into contact with a counterpart-side power supply terminal provided to the counterpart housing upon at least part of the counterpart housing being inserted through the insertion port, the regulatory protruding portion is placed on a side closer to the insertion port than to the exposed portion in the direction of the insertion of at least part of the counterpart housing, in the insertion space, the regulatory protruding portion comprising at least a pair of projections, one of the pair of projections protruding from the upper inner wall in the first direction toward the insertion space, another one of the pair of projections protruding from the bottom-side inner wall in the first direction toward the insertion space, and the locking portion is provided in the insertion space, and is configured to lock a locking portion provided to the counterpart housing upon at least part of the counterpart housing being inserted.

2. The power connector according to claim 1, wherein the power supply terminal includes a plurality of power supply terminals in such a manner as to be adjacent to each other, and a partition is provided between the power supply terminals.

3. The power connector according to claim 1, wherein the contact portion has a flat plate shape.

4. The power connector according to claim 1, wherein the pair of projections is placed in such a manner as to face each other in a plane perpendicular to the insertion direction.

5. The power connector according to claim 4, wherein the insertion space includes a first compartment portion into which the locking portion of at least part of the counterpart housing is inserted upon at least part being inserted, and a second compartment portion into which a part other than the locking portion is inserted upon at least part of the counterpart housing being inserted.

6. The power connector according to claim 5, wherein the plane includes the first direction and a second direction perpendicular to the first direction in the plane perpendicular to the insertion direction, and the pair of projections each protrudes toward an inside of the insertion space along the first direction in such a manner as to be close to each other, and includes an overlap in the second direction.

7. The power connector according to claim 6, wherein the power supply terminal extends in the second direction, and includes a part overlapping with at least one of the pair of projections in the second direction.

8. The power connector according to claim 5, wherein the first and second compartment portions are placed in such a manner as to be adjacent to each other along the first direction, and include a part overlapping in the second direction.

9. The power connector according to claim 8, wherein the first compartment portion is smaller in at least the second direction than the second compartment portion.

10. A power connector device comprising a power connector and a counterpart connector, wherein the power connector comprises:

a housing;

a power supply terminal;

a regulatory protruding portion; and a locking portion, the counterpart connector comprises:

a counterpart housing;

a counterpart-side power supply terminal; and a counterpart-side locking portion, the housing of the power connector includes, therein, an insertion port and an insertion space communicating with the insertion port, the insertion space configured in such a manner that at least part of the counterpart housing is inserted into the insertion space through the insertion port, the insertion space comprises an upper inner wall and a bottom-side inner wall opposite to the upper inner wall in a first direction perpendicular to a direction of the insertion of at least part of the counterpart housing in the insertion space, the power supply terminal includes an exposed portion provided in a state of being exposed from the housing toward the insertion space, and a contact portion being at least part of the power supply terminal, the contact portion being configured to come into contact with the counterpart-side power supply terminal upon at least part of the counterpart housing being inserted through the insertion port, the regulatory protruding portion is placed on a side closer to the insertion port than to the exposed portion in the direction of the insertion of at least part of the counterpart housing, in the insertion space, the regulatory protruding portion comprising at least a pair of projections, one of the pair of projections protruding from the upper inner wall in the first direction toward an inside of the insertion space, another one of the pair of projections protruding from the bottom-side inner wall in the first direction toward the inside of the insertion space, and the locking portion is provided in the insertion space, and is configured to lock the counterpart-side locking portion upon at least part of the counterpart housing being inserted.

11. The power connector according to claim 1, wherein the power supply terminal further includes a mounting portion configured to be mounted on a board, the mounting portion being projected from the housing along the direction of the insertion.

12. The power connector according to claim 1, wherein the housing further includes the insertion port.

* * * * *